US005930925A

United States Patent [19]

Gringer

[11] Patent Number: 5,930,925

[45] Date of Patent: Aug. 3, 1999

[54] DISPLAY APPARATUS

[75] Inventor: Donald Gringer, New York, N.Y.

[73] Assignee: Allway Tools, Inc., Bronx, N.Y.

[21] Appl. No.: 08/779,167

[22] Filed: Jan. 6, 1997

[51] Int. Cl.[6] ..... G09F 3/00

[52] U.S. Cl. ..... 40/314; 40/673

[58] Field of Search ..... 40/314, 299, 611, 40/643, 658, 673, 661.12; 248/473; 206/806

[56] References Cited

U.S. PATENT DOCUMENTS

| | | | |
|---|---|---|---|
| D. 173,461 | 11/1954 | Schaefer | D4/116 |
| 2,317,123 | 4/1943 | Warp | 40/314 |
| 2,489,707 | 11/1949 | Eubanks | 40/314 |
| 3,787,922 | 1/1974 | Foy et al. | 248/473 X |
| 3,797,795 | 3/1974 | Hemgren | 40/658 X |
| 5,522,164 | 6/1996 | Fallon | 40/314 |
| 5,649,621 | 7/1997 | Brody | 206/349 |

*Primary Examiner*—Cassandra H. Davis

*Attorney, Agent, or Firm*—David M. Klein; Shearman & Sterling

[57] ABSTRACT

A display apparatus for an object to be displayed, e.g., a brush, in which the object includes a slot on its external surface. A display card is sized to be inserted into the slot and is removably retained within the slot. Adhesive, or a friction fit, is preferably used to removably attach the display card to the object. In one embodiment, the object to be displayed includes at least one protuberance extending partially into the slot. The display card is sized to be frictionally retained in the slot by the protuberance. The display card may include a folded over portion for increasing the thickness of the display card when it is inserted into the slot. The display card is shaped to correspond to a shape of the object to be displayed when the display card is inserted into the slot, and includes a hole therethrough for enabling the display card to be hung from a display rack.

12 Claims, 5 Drawing Sheets

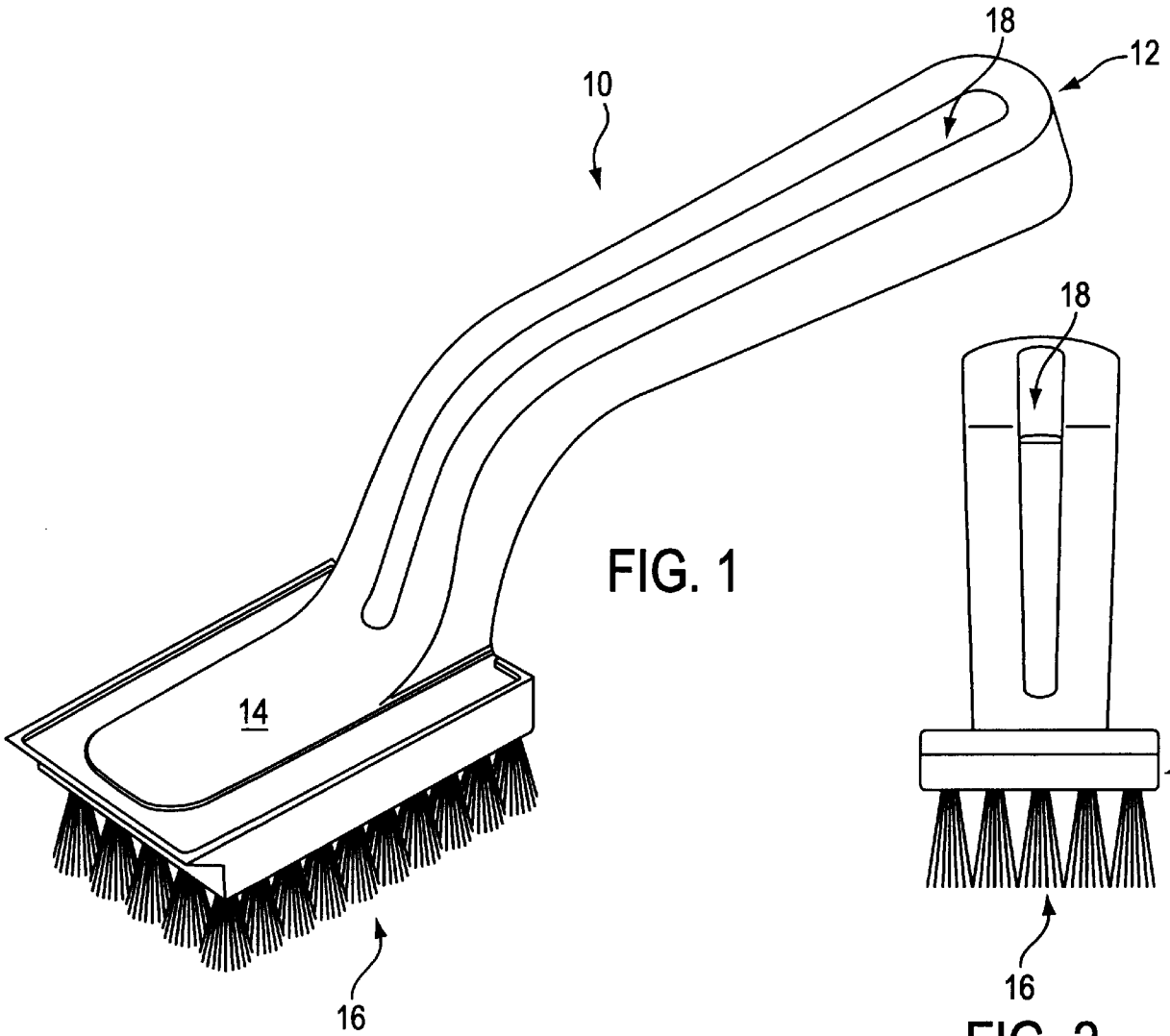
FIG. 1
FIG. 2
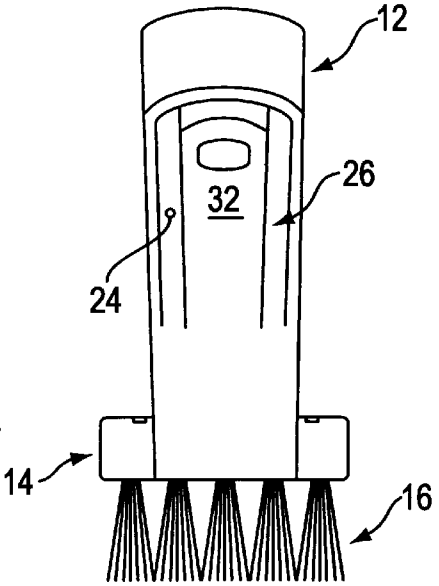
FIG. 3

DISPLAY APPARATUS

BACKGROUND OF THE INVENTION

1. Field of the Invention

The present invention relates to a display card for brushes or other devices, and more particularly to a hanging display card that is inserted into a slot or other device to be displayed so as to enable to device to be suspended on a display rack.

2. Description of the Related Art

There exist many different techniques for displaying articles such as brushes at the point of sale. For example, the articles could be packaged in boxes or other sealed containers and stacked for display. In another type of display, the brush is sandwiched between clear plastic packaging that has been vacuum formed. If desired, the clear plastic packaging may be sealed within a card constructed of cardboard or the like. The cardboard may then include a hole so as to allow the packaged article to be suspended from a display rack. This type of display package suffers from several shortcomings. First, it requires a relatively expensive packaging process because the display packaging must be vacuum formed, the card must be cut, and the display glued within the card. Second, because it requires several different parts, it becomes relatively expensive to package an article.

Also, in Germany and other European countries, packaging in which vacuum formed plastic is sealed to a card is outlawed. The card must be separable from the plastic without de-lamination so as to be recyclable. In general, all packaging in such countries must be recyclable to be acceptable.

Accordingly, there exists a need for a display card that enables the hanging display of articles for sale and that is relatively inexpensive and simple to manufacture, and that is readily recyclable.

SUMMARY OF THE INVENTION

The present invention is a display apparatus for an object to be displayed, e.g., a brush, in which the object includes a slot on its external surface. A display card is sized to be inserted into the slot. Means is provided for removably retaining the display card within the slot. The removable attachment means is preferably an adhesive, or a friction fit.

In one embodiment of the invention, the object to be displayed includes at least one protuberance extending partially into the slot. In this embodiment, the display card is sized to be frictionally retained in the slot by the protuberance. If desired, the display card may include a folded over portion for increasing the thickness of the display card when it is inserted into the slot. The display card is preferably shaped to correspond to a shape of the object to be displayed when the display card is inserted into the slot, and includes a hole therethrough for enabling the display card to be suspended from a display rack.

In a method of the invention, the display card is inserted into the slot in a manner that enables the display card to be removably retained in the slot.

BRIEF DESCRIPTION OF THE DRAWINGS

FIG. 1 is a perspective view of a brush to be displayed in accordance with the invention.

FIG. 2 is an end view of the brush shown in FIG. 1.

FIG. 3 is an opposite end view of the brush shown in FIG. 1.

DETAILED DESCRIPTION OF THE INVENTION

Figure 12:
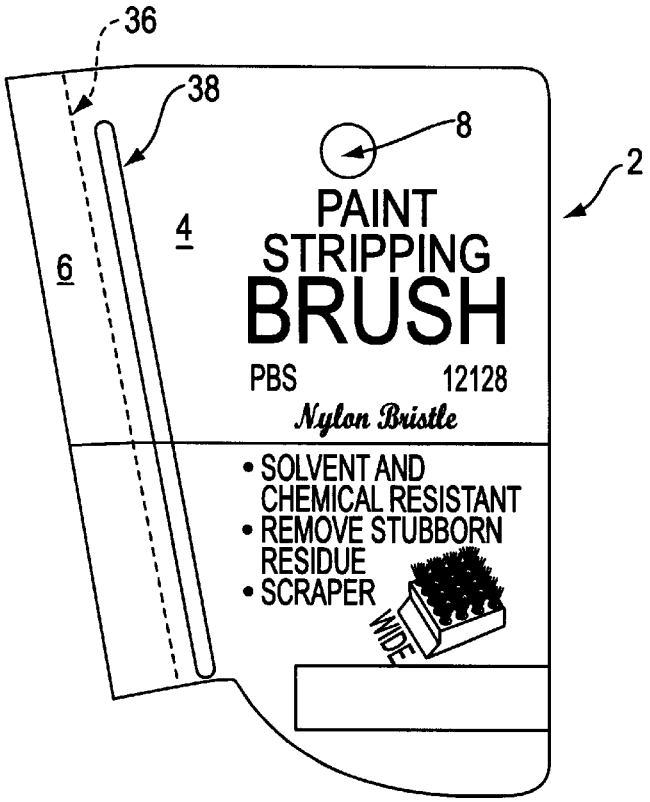
FIG. 12 shows a top view of one embodiment of the display card in accordance with the invention.
Figure 13:
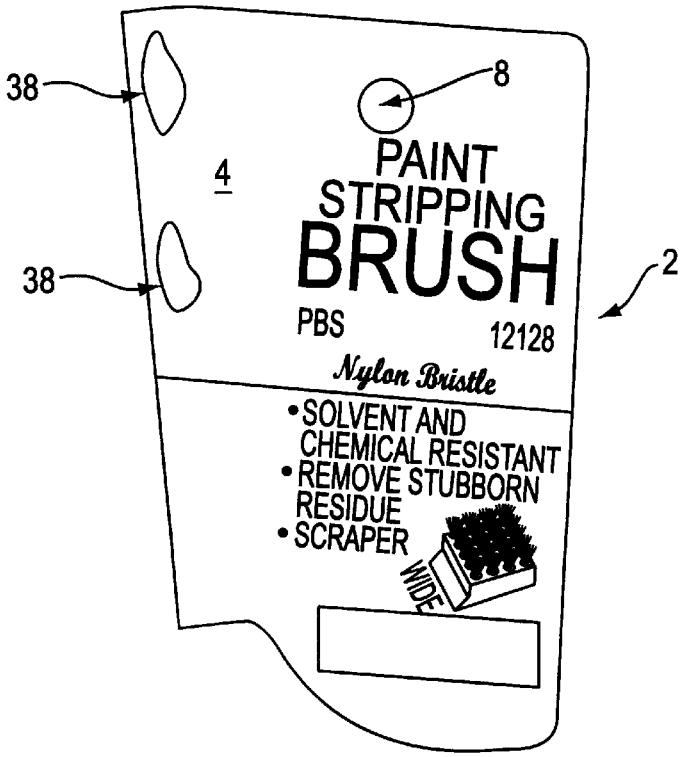
FIG. 13 shows a top view of an alternative embodiment of the display card.

As shown in FIGS. 12 and 13, the present invention is a display card to provide hanging display of articles in connection with a conventional hanging display rack (not shown). Display card 2 is preferably constructed of cardboard, card stock, or any other appropriate material, e.g., plastic, metal, etc., that is suitable for having printed matter displayed thereon, or affixed thereto. Display card 2 includes a body portion 4 that preferably includes sales-oriented display material. It will be appreciated that display card 2 may include promotional information on both sides thereof, if desired. Body 4 of card 2 includes a hole 8 extending therethrough to enable the display card to be suspended on a conventional display rack. Hole 8 may be placed through card 2 by any appropriate technique.

Display card 2 is adapted to be attached to a brush or other article to be displayed. FIGS. 1–9 show a brush 10 which may be, for example, a grout brush, or the like. Brush 10 has a handle portion 12 and a head portion 14. Head portion 14 includes bristles 16 mounted therein by any appropriate technique. Handle 12 and brush head 14 are preferably integrally constructed of any appropriate thermoplastic. It will be appreciated, however, that brush 10 may be constructed of any appropriate material, and by any appropriate technique provided that the brush includes means for mounting display card 2 therein, as discussed below.

Handle 12 includes a centrally disposed slot 18 running lengthwise along handle 12 and defined by upstanding sidewalls 20 and 22. The bottom of handle 12 includes a pair of slots 24 and 26 extending lengthwise along handle 12. Slot 24 is defined between upstanding sidewall 28 and upstanding sidewall 20, and slot 26 is defined between upstanding sidewall 30 and upstanding sidewall 22. Slot 18 is bounded on its lower surface by bottom portion 32.

Figure 4:
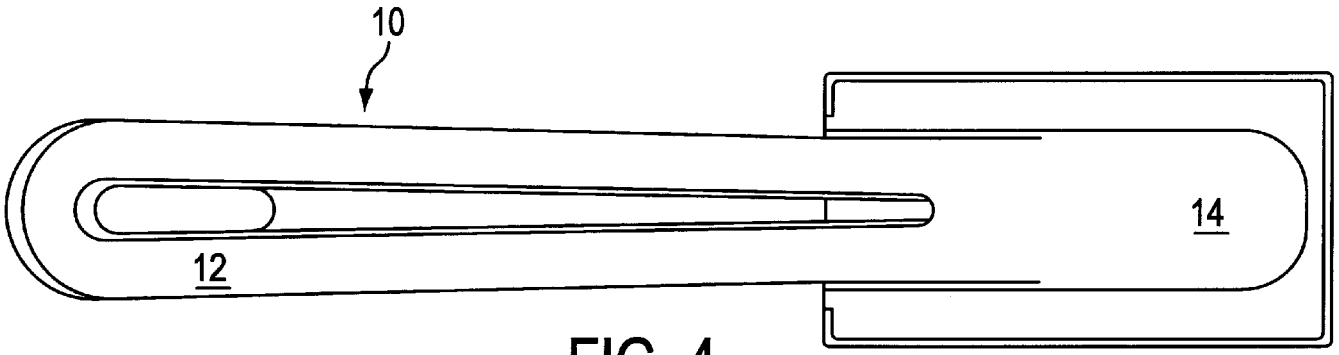
FIG. 4 is a top view of the brush shown in FIG. 1.
Figure 5:
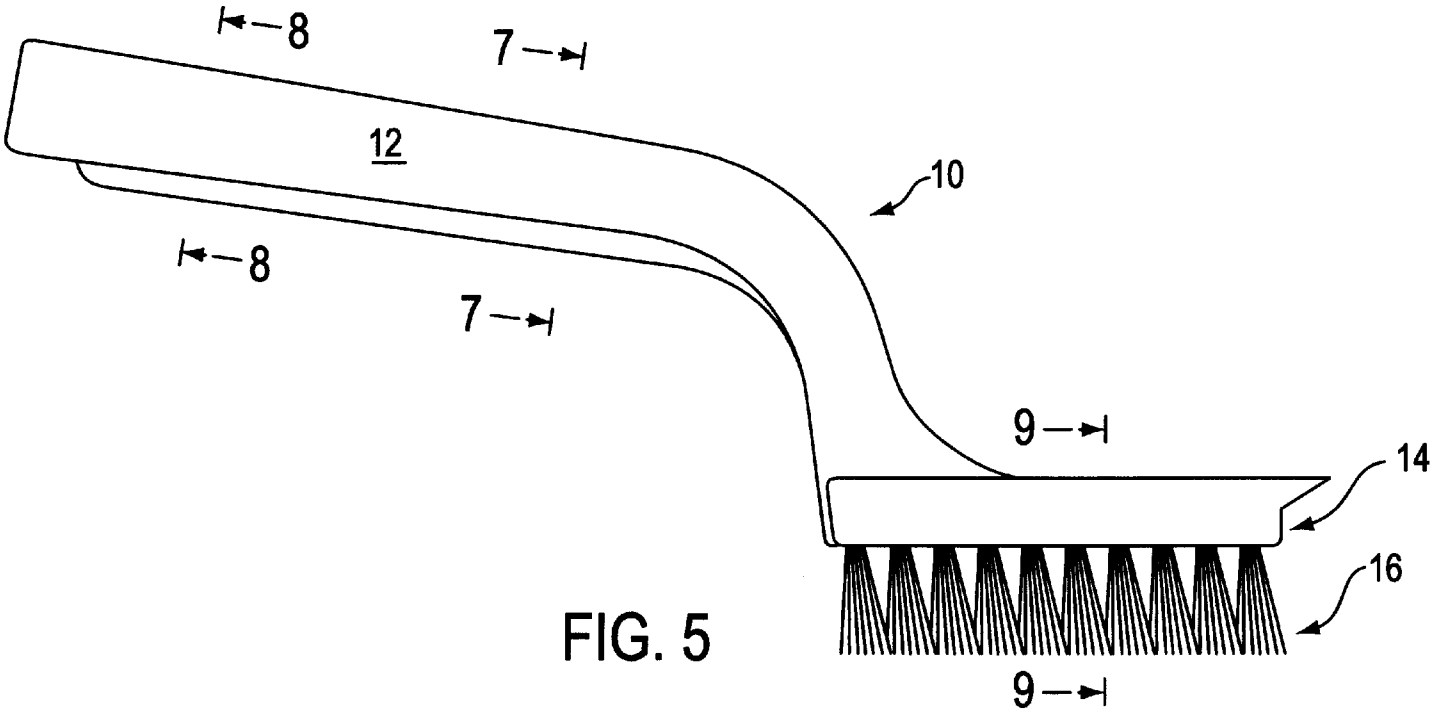
FIG. 5 is a side view of the brush shown in FIG. 1.
Figure 6:
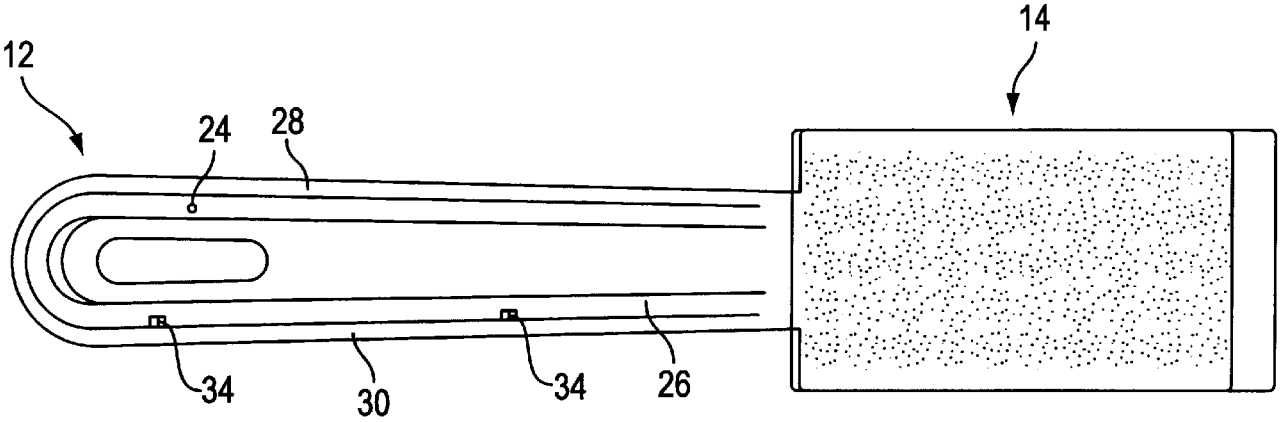
FIG. 6 is a bottom view of the brush shown in FIG. 1.
Figure 7:
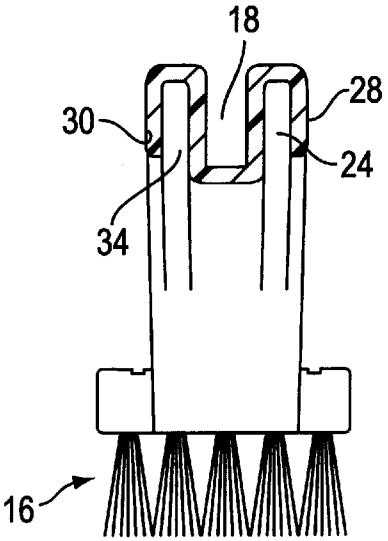
FIG. 7 is a cross-sectional view through Section 7—7 of FIG. 5.
Figure 8:
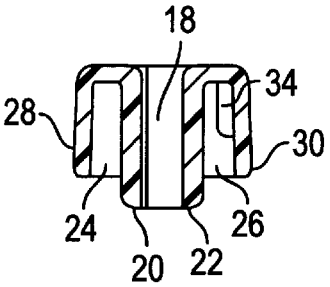
FIG. 8 is a cross-sectional view through Section 8—8 of FIG. 5.
Figure 9:
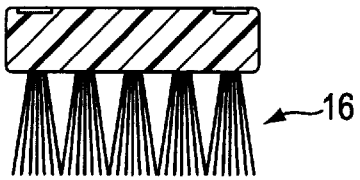
FIG. 9 is a cross-sectional view through Section 9—9 of FIG. 5.
Figure 11:
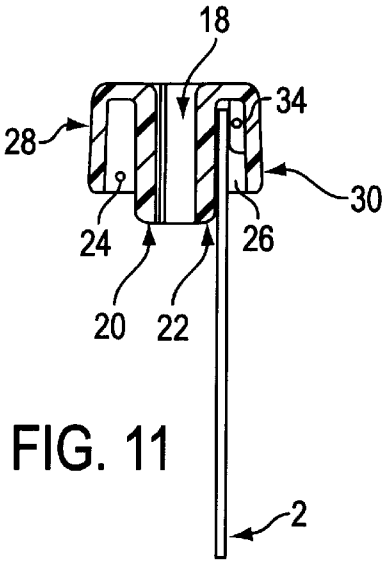
FIG. 11 is a cross-sectional view through Section 11—11 of FIG. 10.
Figure 10:
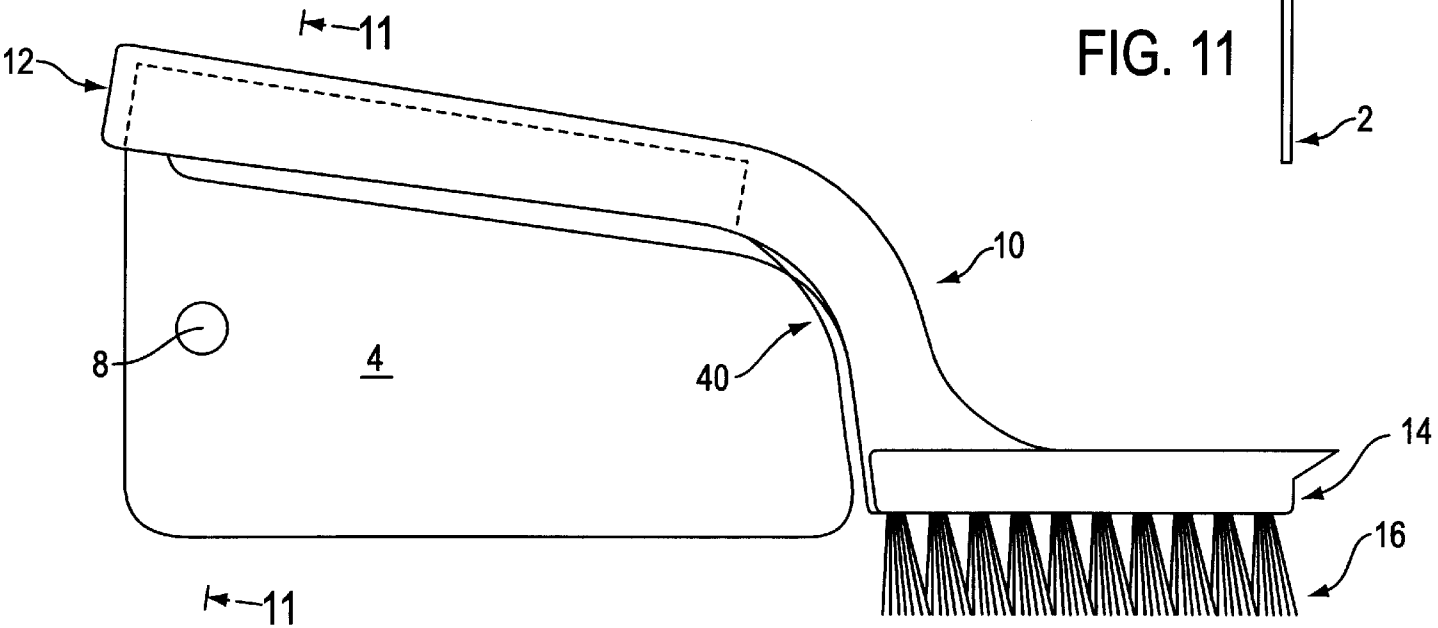
FIG. 10 is a side view of the brush shown in FIG. 1 with the display card of the invention inserted therein.

Disposed within slot 26 is a pair of protuberances 34 that extend somewhat into slot 26. As shown in FIGS. 10 and 11, in order to display brush 12, display card 2 is inserted into slot 26. The thickness of display card 4 is preferably such that it is compressed slightly when pushed into slot 26 by protuberances 34 so that display card 2 is frictionally retained within slot 26 by the protuberances. Accordingly, in order to display the brush for sale, it is only necessary to insert display card 2 into slot 26, at which time the article to be displayed can be immediately placed upon a display rack.

Figure 14:
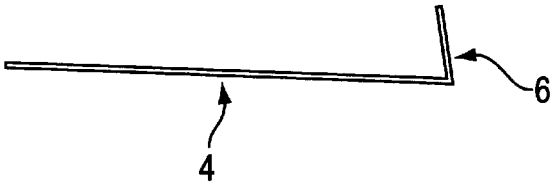
FIG. 14 is a sectional view of the display card shown in FIG. 12 with a tab portion bent.

In an alternative embodiment, as shown in FIG. 12, display card 2 may include a folded over portion 6 that is separated from card body 4 by a crease 36, as shown in FIG. 14. Crease 36 enables portion 6 to be folded over back against card portion 4. This doubles the thickness of the card at the portion that is inserted into handle 12 to thereby improve the frictional force which holds card 2 in the handle. Crease 36 may be made by any appropriate technique that would enable the card to be folded over upon itself. It will be appreciated that in lieu of folded over portion 6, a separate piece of card stock may be attached to body 4 to increase its thickness at the portion that is inserted in handle 2.

Also in order to increase the force holding display card 2 in handle 12, adhesive 38, which is preferably a convention latex adhesive, may be applied to the card body 4 prior to insertion of the card in the handle. Adhesive 38 may be placed on the card in discrete locations, as shown in FIG. 13, or may be applied to the card in a strip, as shown in FIG. 12.

As shown in FIG. 10, body 4 of display card 2 is preferably shaped so that when the card is inserted in the handle, the card matches the contour and curvature 40 of handle 12. It will be appreciated that protuberances 34 are not critical to the invention. For example, provided that a thick enough display card stock is used, it is possible that card 2 could be inserted in slot 24 and held within the slot by frictional resistance, without the need for protuberances 34. In addition, if adhesive is used, this improves the frictional retention force of card 2 in slot 24. It will also be appreciated that the dimensions of slots 24 or 26 and card 2 may be varied so as to insure a strong frictional or adhesive bond between the card and the handle.

While the present invention has been described with respect to a particular brush configuration having a particular ornamental design, it will be appreciated that the invention is applicable to any apparatus in which a slot is provided so that display card 2 may be inserted therein. For example, the invention may be applied to brushes with other shapes, wherein the shape of display card 2 may follow the contour of the brush, if applicable, or to any other apparatus in which it is desired to display the apparatus on a hanging rack with minimal packaging and a minimal cost to attach the packaging to the articles.

Upon the purchase of the article by the user, display card 2 is simply pulled from the slot in which it is inserted with sufficient force so as to overcome the frictional force holding the card in the slot. Similarly, if adhesive is applied to the card, an appropriate adhesive should be used so that moderate force removes the card from the slot.

Although the present invention has been described in detail with respect to certain embodiments and examples, variations and modifications exist that are within the scope of the present invention as defined in the following claims.

What is claimed is:

1. A display apparatus which comprises:

a brush to be displayed, the brush comprising a slot having walls;

a display card sized to be inserted into the slot the display card having opposed surfaces, the slot being positioned on an exterior surface of the brush and oriented on the brush whereby the display card extends laterally from the brush when inserted in the slot to facilitate hanging of the brush by the display card; and means for removably retaining the display card within the slot selected from the group consisting of adhesive and friction engagement of the opposed surfaces of the display card with the walls of the slot.

2. The apparatus according to claim 1 wherein the brush comprises at least one protuberance extending partially into the slot, the display card being sized to be frictionally retained in the slot by the protuberance.

3. The apparatus according to claim 1 wherein the display card comprises a fold over portion for increasing the thickness of the display card when inserted into the slot.

4. The apparatus according to claim 1 wherein the display card is shaped to correspond to a shape of the brush when the display card is inserted into the slot.

5. The apparatus according to claim 1 wherein the display card comprises a hole for enabling the display card to be suspended from a display rack.

6. A method of displaying a brush to be displayed, the brush comprising a slot positioned on an exterior surface of the brush and oriented on the brush whereby a display card may be inserted into the slot laterally extending from the brush to facilitate hanging of the brush by the display card, the display card having opposed surfaces and the slot having walls, the method comprising the step of inserting the display card into the slot so that the display card is removably retained in the slot by Means of adhesive or frictional engagement of the opposed surfaces of the display card with the walls of slot.

7. The method according to claim 6 wherein the display card is removably retained in the slot by applying adhesive to the display card prior to inserting the display card into the slot.

8. The method according to claim 6 wherein the brush comprises at least one protuberance extending partially into the slot, the display card being removably retained in the slot by inserting the display card into the slot so that the display card is frictionally retained by the protuberance.

9. The method according to claim 6 wherein the display card is removably retained in the slot by folding over a portion of the display card for increasing the thickness of the display card, and inserting the folded over portion of the display card into the slot so that the display card is frictionally retained in the slot.

10. The method according to claim 6 wherein the display card is shaped to correspond to a shape of the brush when the display card is inserted into the slot.

11. The method according to claim 6 wherein the display card comprises a hole for enabling the display card to be hung from a display rack.

12. The method according to claim 11 further comprising the step of hanging the display card from a display rack.

* * * * *